US008601903B1

(12) United States Patent
Klein et al.

(10) Patent No.: US 8,601,903 B1
(45) Date of Patent: Dec. 10, 2013

(54) CLOSING SYSTEM, ESPECIALLY FOR MOTOR VEHICLES

(75) Inventors: Helmut Klein, Velbert (DE); Stefan Lange, Velbert (DE); Reinhold Mathofer, Wülfrath (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/088,451

(22) PCT Filed: Aug. 16, 2000

(86) PCT No.: PCT/EP00/08317

§ 371 (c)(1),
(2), (4) Date: Jun. 12, 2002

(87) PCT Pub. No.: WO01/20108

PCT Pub. Date: Mar. 22, 2001

(30) Foreign Application Priority Data

Sep. 14, 1999 (DE) ..... 199 43 986
Sep. 14, 1999 (DE) ..... 299 16 092 U

(51) Int. Cl.
*G05G 1/10* (2006.01)
*E05B 7/00* (2006.01)

(52) U.S. Cl.
USPC ..... 74/543; 74/545; 16/110.1; 340/5.62; 70/214

(58) Field of Classification Search
USPC ..... 74/523, 543, 544, 545, 546; 37/348; 340/5.62; 16/110.1; 70/214
See application file for complete search history.

(56) References Cited

U.S. PATENT DOCUMENTS

| | | | | |
|---|---|---|---|---|
| 4,936,122 | A * | 6/1990 | Osada | 70/214 |
| 6,075,294 | A | 6/2000 | Van den Boom et al. | |
| 2002/0046439 | A1 * | 4/2002 | Agostini et al. | 16/110.1 |
| 2002/0046440 | A1 * | 4/2002 | Agostini et al. | 16/110.1 |
| 2002/0093418 | A1 * | 7/2002 | Schmitz et al. | 340/5.62 |
| 2002/0166267 | A1 * | 11/2002 | McGugan | 37/348 |

FOREIGN PATENT DOCUMENTS

| | | | | |
|---|---|---|---|---|
| DE | 19617038 | | 11/1997 | |
| DE | 197 45 149 | A1 | 4/1999 | |
| DE | 198 16 603 | C1 | 8/1999 | |
| EP | 001031684 | A1 * | 8/2000 | 16/110.1 |
| EP | 1052349 | | 11/2000 | |
| EP | 1067257 | | 1/2001 | |
| EP | 001108835 | A2 * | 6/2001 | 16/110.1 |
| EP | 001128003 | A1 * | 8/2001 | 16/110.1 |
| EP | 001245761 | A2 * | 10/2002 | 16/110.1 |
| EP | 001277900 | A1 * | 1/2003 | 16/110.1 |
| EP | 001318255 | A2 * | 6/2003 | 16/110.1 |
| EP | 001291477 | A2 * | 12/2003 | 16/110.1 |
| WO | 9919585 | | 4/1999 | |
| WO | 9928170 | | 6/1999 | |

* cited by examiner

*Primary Examiner* — Vinh T. Luong
(74) *Attorney, Agent, or Firm* — Friedrich Kueffner

(57) ABSTRACT

A closing system for doors having a container provided in a handle. The container has a touch surface that is placed in a window-type recess of the handle, and a switching element that is arranged in the container can be actuated by the touch surface. The switching element is used to switch the control electronics of the closing system between two states, namely a state that prevents opening of the door and a state that allows the door to be opened.

17 Claims, 8 Drawing Sheets

CLOSING SYSTEM, ESPECIALLY FOR MOTOR VEHICLES

BACKGROUND OF THE INVENTION

The invention relates to a closing system for a motor vehicle. In such a closing system, an electronic control is activated by means of a switching element which is integrated into a handle and transfers a lock provided on the vehicle door, flap, or car body from a state preventing opening of a door, flap or the like into a state allowing opening of the door, flap or the like. The field of application of the invention is directed in particular to motor vehicles, access to safety areas and the like.

In closing systems of the aforementioned kind it is known to allow a person access to, for example, a vehicle by a data inquiry of a data carrier, for example, a check card (keyless go). The data inquiry is triggered by a mechanical switching element provided on the door, flap or the like in the area of the handle and installed on the door handle or at least in the area of the door handle. The person requesting access triggers this data inquiry of the data carrier by a control unit, for example, in the vehicle, by actuating the switching element, more precisely, by moving the handle. The triggered pulse is then transmitted from the control unit to a sender which transmits the data inquiry to the data carrier. The data carrier receives the command for data inquiry and transmits it further to a data unit which transmits the required data to a sender. The sender transmits the data then to the control unit in the vehicle by means of the sending/receiving unit of the vehicle, wherein, in the case of positive data recognition, the control unit triggers a command for releasing the locking system.

The electronic device correlated with the switch is protected against exposure to water by encapsulation, for example, in a plastic material. This results in a time-consuming and expensive manufacture.

Moreover, the data inquiry takes place with a first actuation of the handle, such as the handle bracket or handle flap of a door handle, only when the user pulls on it and thereby triggers the switch. The data inquiry accordingly occurs at a relatively late point in time because, as can be taken from the above description, a few steps still follow. This delayed data inquiry as well as the subsequent response time of a central lock makes such a system uncomfortable. In many cases this has the result that the closing system upon first actuation of the door handle is not yet released and the person requesting access must actuate the door handle again in order to open a door.

Moreover, from DE 197 45 149 a handle for a motor vehicle is known which is comprised of two shells. In the interior of the inner shell a switching element is positioned which is embodied as a sending/receiving unit. This switching element is coated with an insulating layer. In the outer shell a cutout is provided for a push button which allows locking of the closing system by actuation it. A disadvantage of this device is that the encapsulation of the switching element in the inner shell, for example, with a plastic material, results in a time-consuming manufacture.

SUMMARY OF THE INVENTION

It is an object of the invention to develop a closing system which avoids the aforementioned disadvantages.

The special feature of the measures described therein is the integration of the switching element in a container which has at least on one accessible side a switching surface for actuating the switching element. The handle has a receptacle into which the container with the switching element is introduced when mounting the handle. In the area of the receptacle the handle has a penetration in its outer wall. In this penetration the container surface supporting the switching surface is positioned when the container is inserted into the receptacle. The switching surface can be flush with the penetration of the handle. The switching surface of the container, however, can also project past the penetration of the handle and/or can overlap the adjoining areas of the outer wall of the handle partially at one or more sides of the switching surface. The penetration can be provided in the grip shell of the handle but can also be of a two-part configuration so that one part of the penetration is positioned in the grip shell of the handle and the second part of the penetration in the grip cover of the handle. The container is preferably of a water-tight configuration so that the sensitive switching elements are protected against water penetration and short-circuiting as a result of penetrated moisture cannot occur. As a result of the arrangement of the switching elements in a water-tight container, manufacturing costs are moreover considerably lowered because the complex encapsulating of the separate interior of the handle is no longer required.

The switching surface of the container is arranged directly on the inner surface of the handle so that an actuation of the switching elements is already carried out upon contacting of the switching surface when the hand of the user grips the handle. Accordingly, the handle must no longer be pulled in order to trigger the release process of the lock. This has the advantage that the response time of the system is significantly reduced in respect to the presented request for access.

Particularly advantageous is an embodiment in which the provided switching elements are electronically operating push switching elements. These electronically operating push switching elements have the advantage that the switching path is very short and that this results in a time saving allowing a fast response of the electronic control of the closing system to the request for access to the vehicle expressed by the user.

It may be furthermore expedient to provide an additional penetration in the handle in which an additional sensor for securing the locking system is arranged. This additional penetration can also be arranged, for example, on another side of the handle.

BRIEF DESCRIPTION OF THE DRAWING

Further measures and advantages of the invention result from the dependent claims, the following description, and the drawings. In the drawings three embodiments of the invention are illustrated. It is shown in:

DETAILED DESCRIPTION OF THE INVENTION

Figure 1:
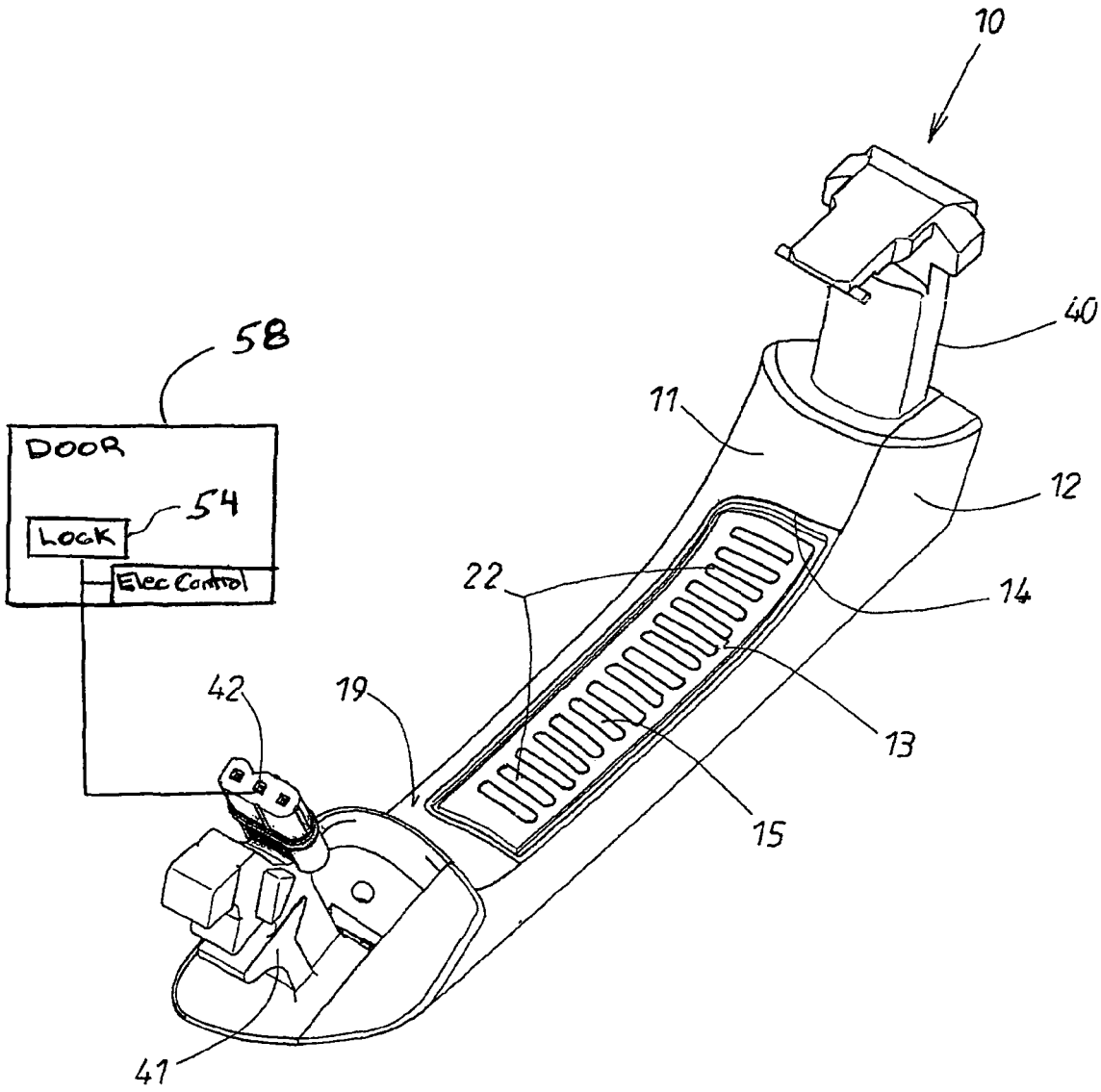
FIG. 1 a handle according to the invention in a schematic three-dimensional view.
Figure 2:
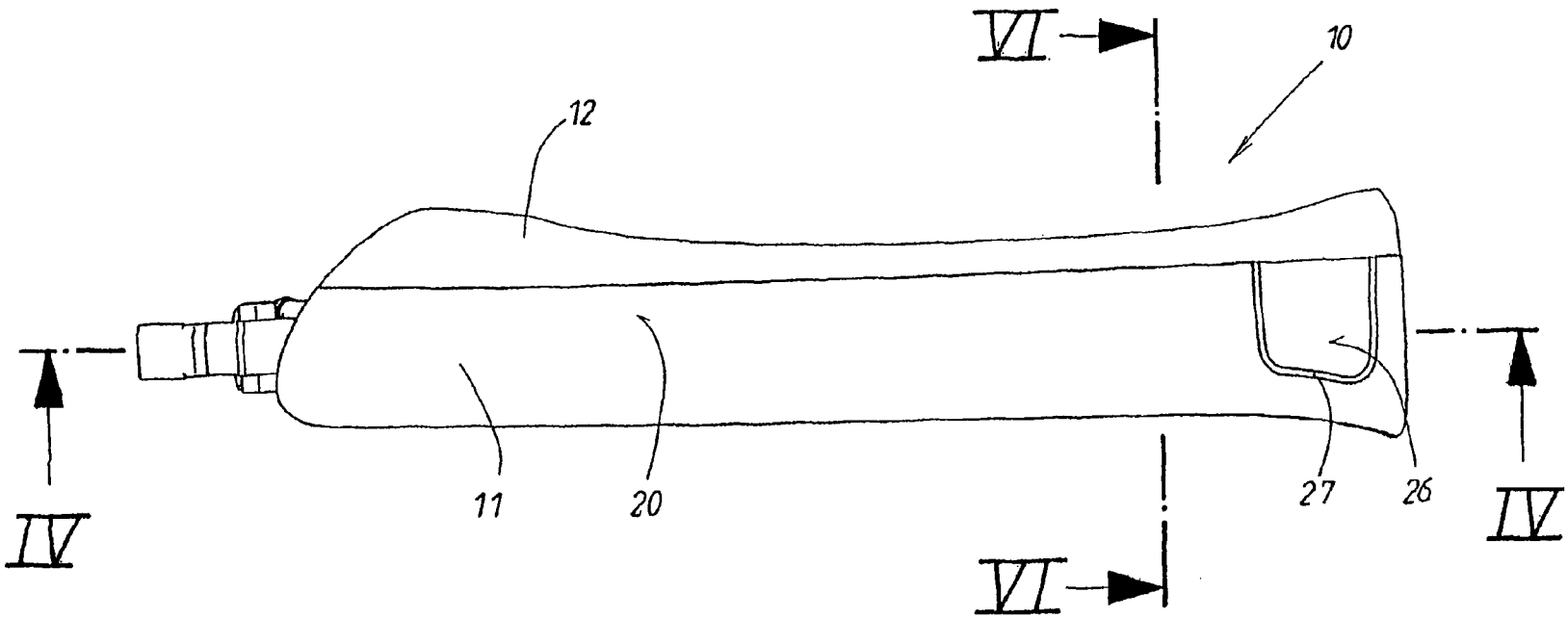
FIG. 2 a schematic side view of the inventive handle of FIG. 1.
Figure 3:
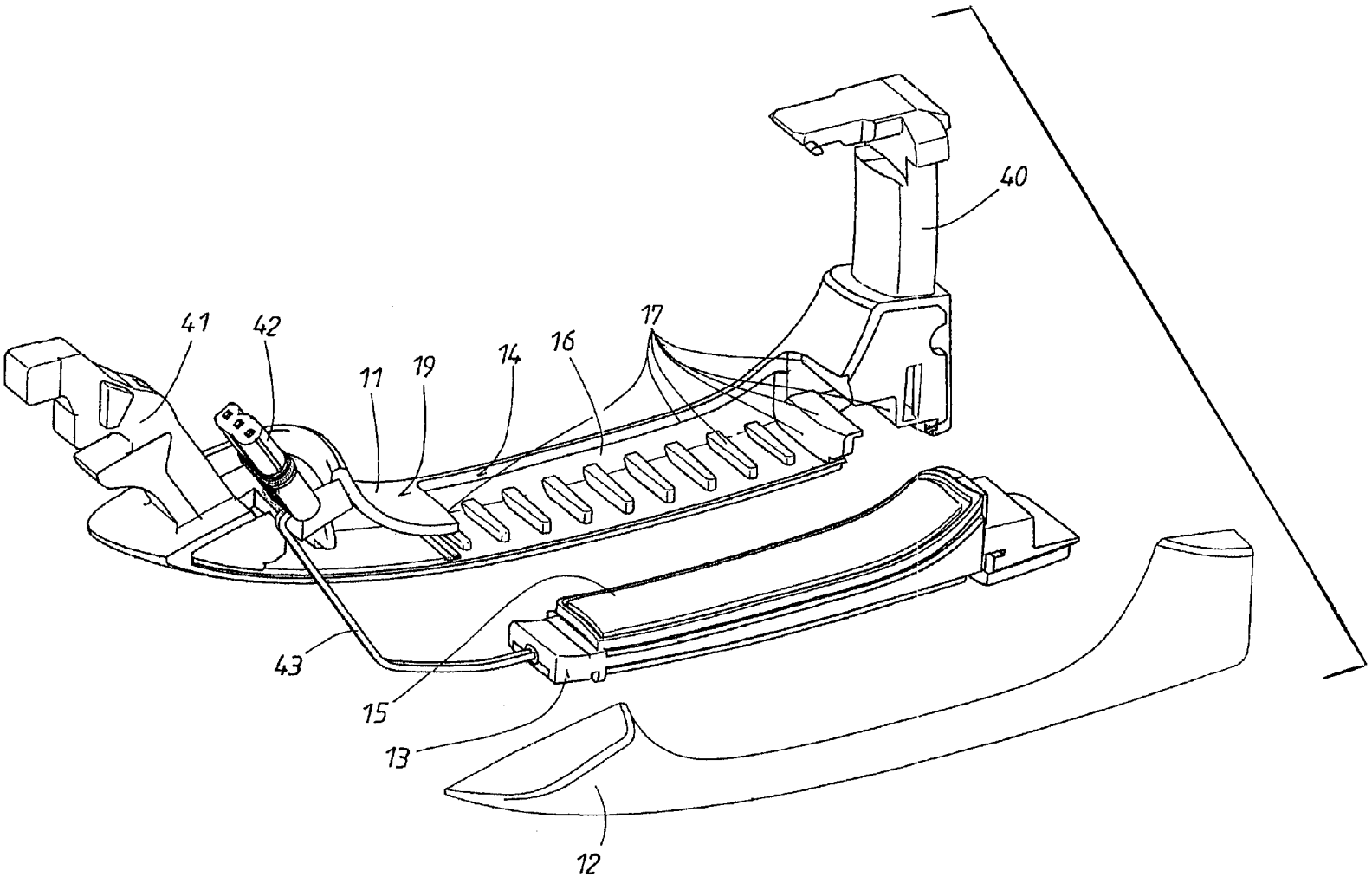
FIG. 3 the handle according to the invention of FIG. 1 in an exploded three-dimensional illustration.
Figure 4:
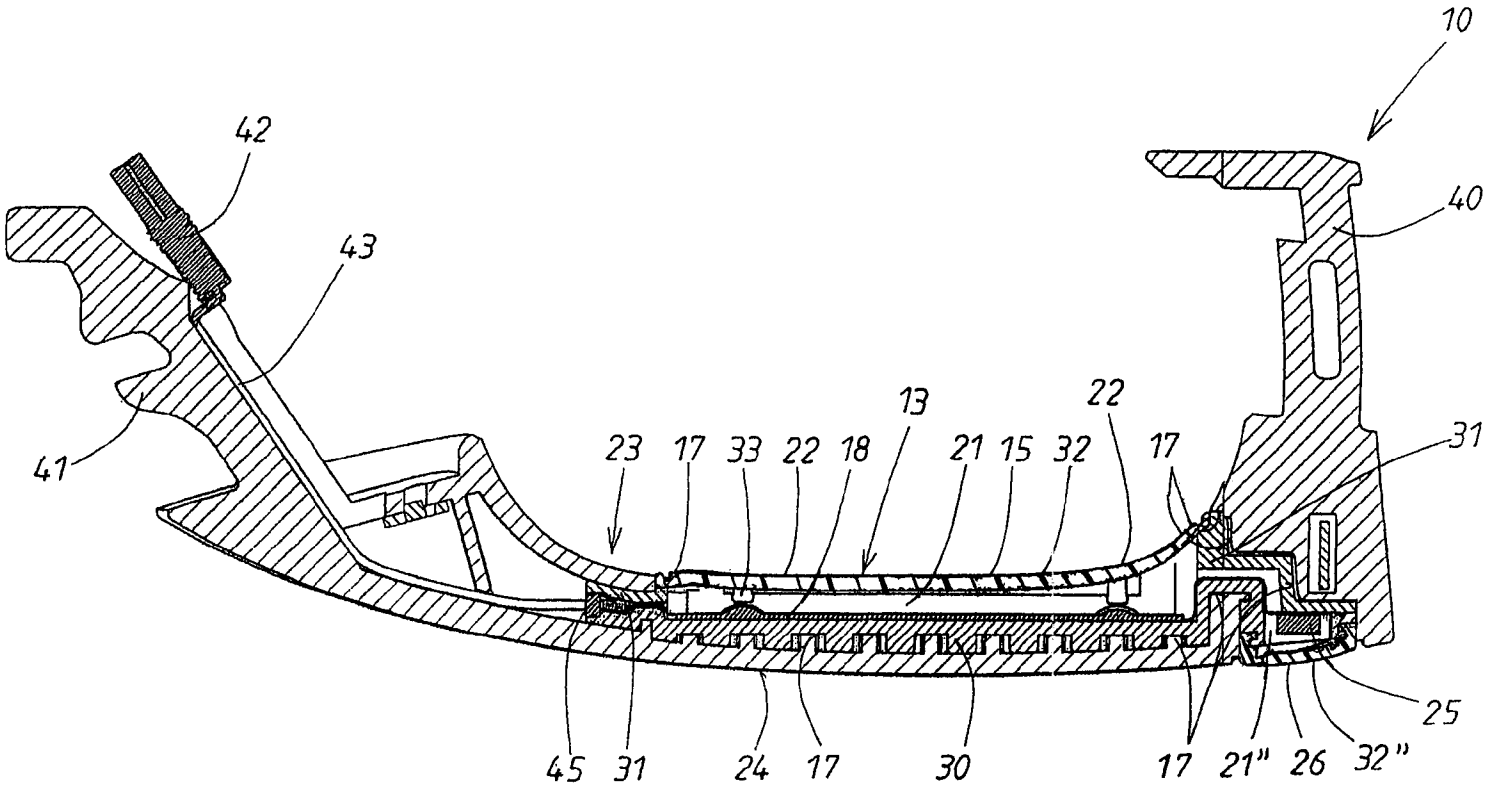
FIG. 4 the first embodiment of the handle according to the invention in a longitudinal section along section line IV-IV of FIG. 2.

In FIGS. 1 through 4 and 6 a first embodiment of a handle for the closing system according to the invention is illustrated. The handle 10 is comprised of a base shell 11 on which a cover part 12 is positioned. At one end of the handle an actuator arm 40 is provided by means of which a door lock can be actuated when the handle according to the invention is mounted on a vehicle. This grip arm 40 is however not mandatory because there are already systems known with which the opening of the lock and the release of the door can be realized automatically after recognizing the access authorization of the person requesting access. At the forward end of the handle 10 in this embodiment of a plug part 42 is arranged with which the switching element or elements arranged in the handle are connected with the electronic device of the vehicle and/or a lock.

In the rearward outer wall 19 of the handle which, when the handle is mounted on the door, faces the door, a window cutout 14 is left open. This window cutout 14 is provided in the area of a receptacle 16 (see, in particular, FIG. 3) into which a container containing the switching elements 18, 25 is pushed and/or inserted.

The container 13 has a touch surface 15 which is manufactured, for example, of a soft to rubber-elastic synthetic material and which positive-lockingly adjoins the surrounding window cutout 14 when the container is inserted and/or pushed into the receptacle 16 of the handle 10. On the touch surface 15 special markings 22 can be provided which the hand gripping the handle can sense by touch.

In the present first embodiment, on the front-facing outer wall 20 of the handle an additional window cutout 27 is provided in which an additional touch surface 26 is provided. This touch surface 26 in the present embodiment is arranged on the same container 13 as the touch surface 15.

In the receptacle 16 various stays and inner surfaces of the handle are formed as guides 17 with which the container 13 is secured almost without play in the receptacle 16 of the handle 10.

The container according to the invention is configured substantially as follows. It is comprised of a peripheral wall 31 which encloses a container interior 21 on four sides. At the underside of the container 13 the bottom part 30 adjoins the peripheral wall 31. At the upper side of the container 30 it is closed off by a cover part 32 which comprises the touch surface 15. In the area of the second additional touch surface 26 the container is closed off by the cover part 32". The cover parts are preferably made of a soft-elastic or rubber-elastic plastic material. All parts of the container 13 are preferably adhesively connected or welded so that a water-tight closed container interior 21, 21', 21" results. In the container interior 21 the switching elements 18 in the form of a switching foil is arranged on the bottom part 30. For actuating the switching foil 18, control means are arranged on the inside of the cover part 32. In the interior 21" of the container 13 an additional switching element 25 in the form of a microswitch is arranged. This microswitch 25 can be actuated directly via the touch surface 26. The connection of the switching elements 18, 25 with the electronic control and/or the lock is achieved by electric control lines 43 which are connected to the plug part 42. The plug part 42 during mounting is connected with a counter plug from where the electrical control lines extend to the electronic control or to the lock. In order to ensure a water-tight guiding of the cable 43 into the container 13, a special cable passage 45 is provided at its forward area in which the cable is surrounded, for example, by rubber-elastic material so as to be media-tight.

Figure 5:
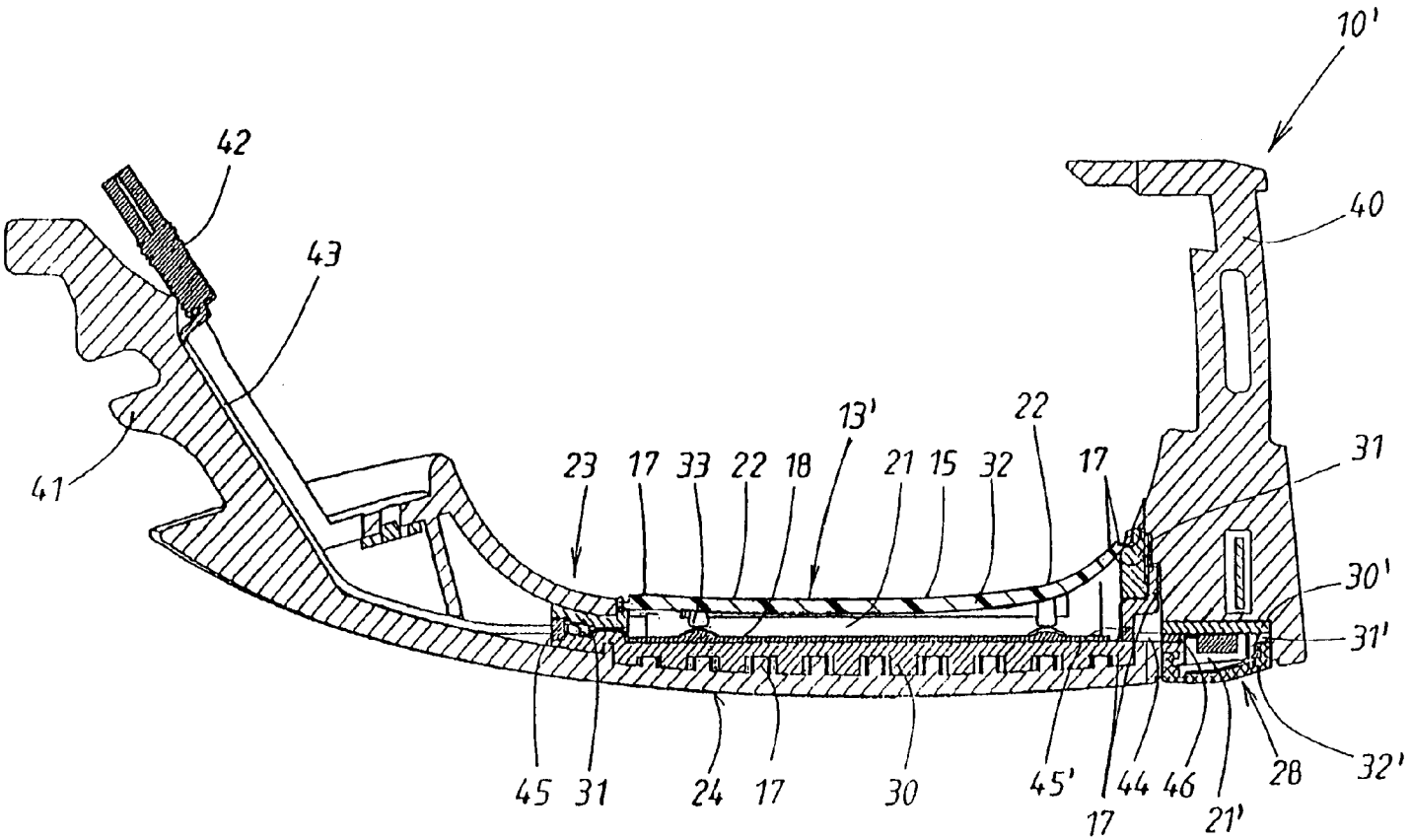
FIG. 5 a longitudinal section of a further embodiment of the handle according to the invention in a section view analog to FIG. 4.
Figure 6:
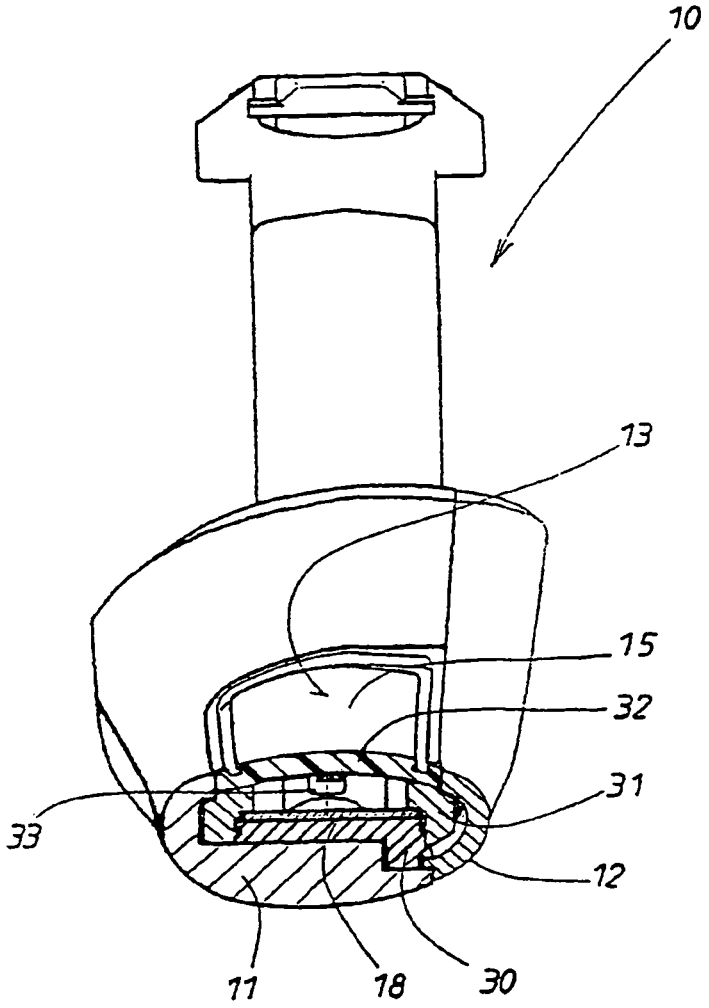
FIG. 6 a cross-section of the handle according to the invention along section line VI-VI of FIG. 2.

In a second embodiment of the handle 10' according to the invention, as illustrated in FIG. 5, the container 13' as well as a second container 28 are provided. The following additional features in comparison to the preceding description are present. Between the first container 13' and the second container 28 an additional electric control line 44 is provided which is guided out of the first container 13' via the cable passage 45' and which extends via the cable passage 46 into the second container 28. The second container 28 has a separate bottom part 30' which covers the peripheral wall 31' in the downward direction. The container 31' is closed to the exterior by the cover part 32' in which the touch surface 26 is positioned. This container is also media-tight by means of welding or adhesive connection.

Figure 7:
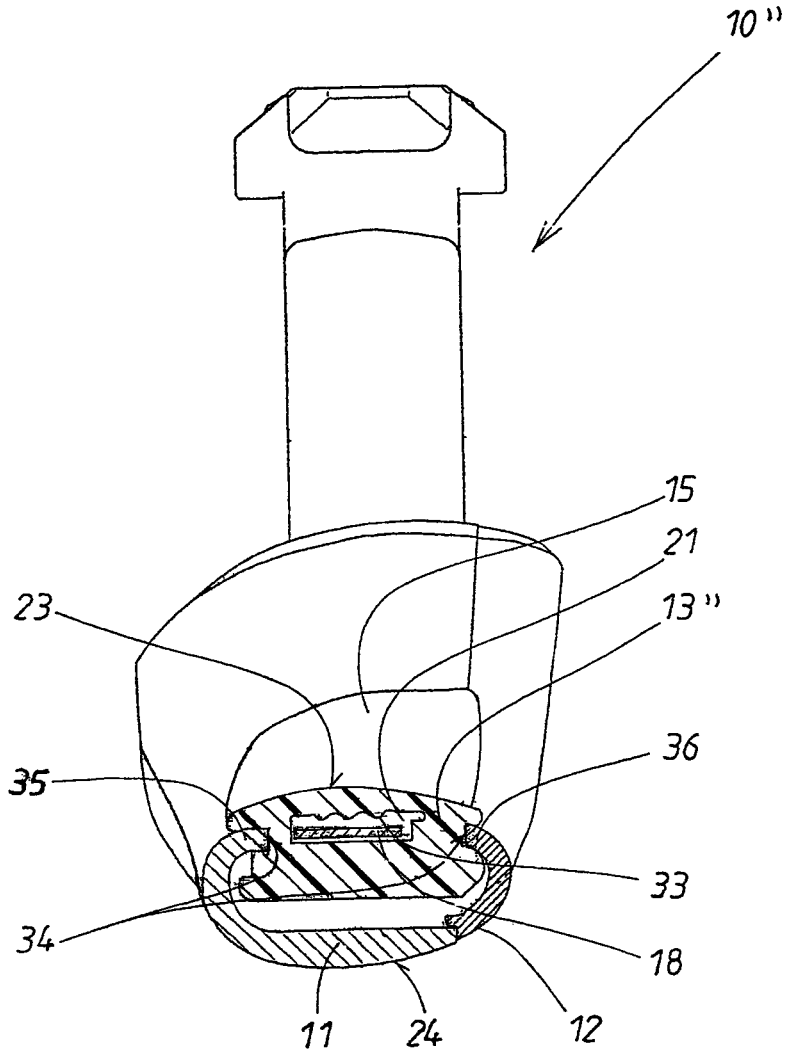
FIG. 7 a third embodiment of the handle according to the invention in a cross-section corresponding to FIG. 6.

In FIG. 7 a third embodiment of the invention is illustrated. The handle 10" illustrated here is comprised also of a base shell 11 and a cover part 12. The container 13" is however configured as a monolithic part of light plastic material which in its interior surrounds the container interior 21. In this interior, the switching element 18 is again positioned which in this embodiment is formed again of a switching foil. The container part 13" is formed such that it has grooves 34 on both its lateral surfaces. In the mounted state of the handle 10", the edges 35, 36 of the base shell 11 and of the cover part 12 engage these grooves 34 substantially positive-lockingly. In this way, the container part is position-secured in the handle substantially without play. For facilitating actuation of the switching element 18, control means 33 are again provided on the inner side of the touch surface 15 which shorten the switching path as a result of the spatial distance between the switching surface and the switching element.

In the same sense as described above, a second container, of course, can also be provided whose touch surface is arranged on the side of the handle facing away from the door, in contrast to the one illustrated here provided on the side 23 of the handle 10" facing the door.

Also, a container of a monolithic configuration could have touch surfaces on both sides 23, 24 of the handle.

Figure 8:
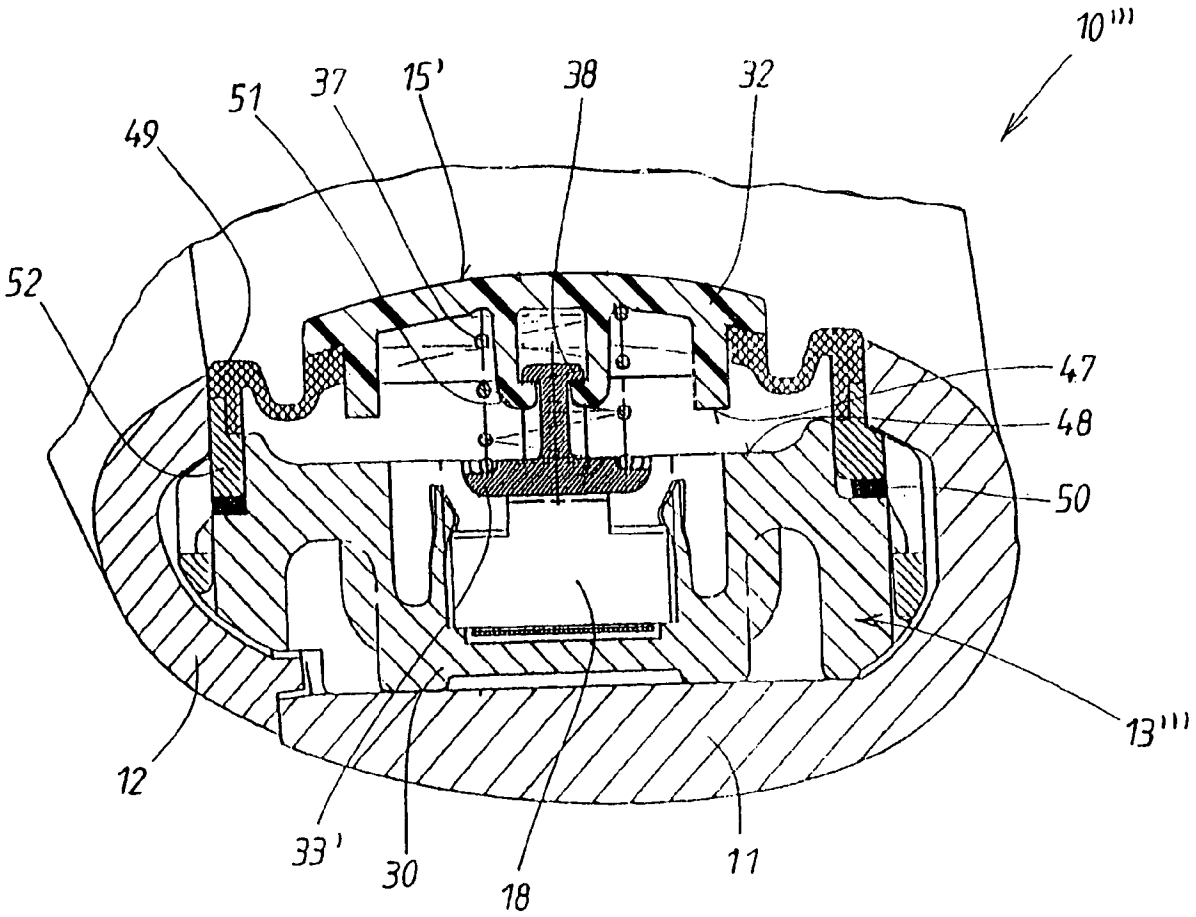
FIG. 8 a fourth embodiment of the inventive handle in a cross-section according to FIG. 6.

In a fourth embodiment of the handle 10''' according to the invention, as shown in FIG. 8, the container 13''' is provided with only one switching element 18 in the form of a microswitch. This microswitch 18 is arranged in the area of the handle 10''' which neighbors the actuator arm (not illustrated in this embodiment). One end of the touch surface 15' is supported pivotably. On the end of the touch surface 15' opposite the switching element 18 a securing collar 51 is arranged in which one end 38 of a plunger 33' is supported in liftable way. The plunger 33' is supported by means of a spring element 37 on the inner surface of the touch surface 15'. The plunger 33' is positioned in the actuation direction above the microswitch 18. This arrangement of touch surface 15', plunger 33' and spring element 37 together forms advantageously a springy pressure limit for the microswitch by which possible tolerances of the participating components can be compensated. A sufficient movability of the touch surface 15' on the container 13''' is ensured by a membrane 49 extending circumferentially about the touch surface 15'. This membrane 49 provides a media-tight connection between the touch surface 15' and the wall 52 of the container 13'''. The bottom part 30 of the container can moreover be sealed by sealing elements 50 relative to the wall 52. The adjusting stroke of the touch surface 15' in the area of the microswitch 18 in this embodiment is limited also by stops 47 formed on the touch surface 15' which can impact on stop surfaces 48 of the bottom part 30 of the container 13'''. The further configuration of the handle 10''' according to the invention corresponds to that of the already described handles.

The present invention is not limited to the form of the handle illustrated here. Also conceivable is a handle whose base shell at the facing side is covered by a cover part such as, for example, a front cover wherein in the front cover a window cutout for the touch surface of a container can be provided. It is also possible to provide a window cutout in which a touch surface of the container is arranged on the bottom side of the base shell facing the vehicle door.

Also, the base shell can be covered relative to the vehicle door by a cover part or a similar part and the window cutout in which the touch surface of a container is positioned can be entirely arranged within the cover part.

The touch surface 15 illustrated here and positioned facing the door and the switching element 18 which is to be actuated by it is provided for initializing an access authorization inquiry of an electronic control arranged in the vehicle to a data carrier provided on the user such as, for example, a data card of a keyless go closing system. When the user touches the touch surface 15 and thus triggers a switching process in the switching element 18, an electronic pulse is sent to the electronic control (not illustrated here) in the vehicle and/or in the door. The electronic control then transfers in fractions of a second an inquiry of the authorization data to the access data on a key card (data carrier), not illustrated, of the user. The key card then also provides within fractions of a second the access data stored therein to the electronic control which examines them and, in the case of positive data recognition, allows access to the user. The access authorization can be provided either in that the handle is released so that the user, upon further pulling of the handle, such as, a door handle or the like, achieves opening of the door lock or in that the electronic control acts directly onto the lock and the door or flap or the like is opened directly, without any further action by the user, via the lock that releases the door.

In contrast to this, the second switching element 25 described above can be provided for securing the closing system. When the user touches the touch surface 27 and thus actuates the switching element 25, the closing system is transferred into a state in which the lock prevents opening of the door or the flap or the like.

The invention claimed is:

1. Closing system for motor vehicles, comprised of a handle (10) comprised of two shells (11, 12), one of which is a base shell, and a lock (54) on the vehicle on at least one door (58) as well as an electronic control, wherein the lock (54) can be switched between two states, i.e., a first state, preventing opening of the door (52) and a second state, allowing opening of the door (58) and wherein in the area of the handle (10) at least one switching element (18) is arranged with which the electronic control can be activated, via which the lock (54) can be transferred from its first state into the second state allowing opening of the door (58), wherein the switching element (18) is integrated media-tight in a container (13, 13', 13'', 13'''), and the container (13, 13', 13'', 13''') on at least one side has a touch surface (15') for actuating the switching element (18), and the container (13, 13', 13'', 13''') is introduced without play into a receptacle (16) of the base shell (11) of the handle (10, 10', 10'', 10'''), and the base shell (11) of the handle (10, 10', 10'', 10''') has a window cutout (14) in its outer wall (19, 20) in the area of the receptacle (16) in which, when the container (13, 13', 13'', 13''') is inserted into the receptacle (16), the touch surface (15, 15') is positioned in a form-locking manner.

2. Closing system according to claim 1, wherein in an area of the receptacle (16) guides (17) are provided in the handle (10, 10', 10'', 10''') for a shock-safe securing of the container (13, 13', 13'', 13''').

3. Closing system according to claim 1, wherein the switching element (18) is electronically operating push switching elements.

4. Closing system according to claim 1, wherein an additional switching element (25) for securing the closing system is mounted in the handle (10) which can be actuated by another touch surface (26).

5. Closing system according to claim 4, wherein the additional switching element (25) for securing the closing system is integrated into the container (13).

6. Closing system according to claim 5, wherein the additional switching element (25) for securing the closing system is arranged at the side of the container (13) opposite the touch surface (15).

7. Closing system according to claim 1, wherein the switching element (18, 25) is a microswitch.

8. Closing system according to claim 1, wherein the switching element (18, 25) is a pressure sensor.

9. Closing system according to claim 1, wherein the switching element (18, 25) is a switching foil.

10. Closing system according to claim 1, wherein the container (13, 13', 13''') is an enclosed component.

11. Closing system according to claim 1, wherein the container (13, 13', 13''') is of a unitary configuration and the switching element (18, 25) is enclosed in its container interior (21).

12. Closing system according to claim 1, wherein the container (13, 13', 13''') is closed in a media-tight way.

13. Closing system according to claim 1, wherein the handle (10, 10', 10'', 10''') is comprised of the base shell (11) comprising the receptacle (19) and a cover part (12).

14. Closing system according to claim 1, wherein the window cutout (14) is arranged on the side (23) of the handle (10, 10', 10'', 10''') facing the door.

15. Closing system according to claim 1, wherein the window cutout (27) is arranged on the side (24) of the handle (10) facing away from the door.

16. Closing system according to claim 1, wherein the switching element (25) for securing the closing system is arranged in the window cutout (14) arranged at the side (24) of the handle (10) facing away from the door.

17. Closing system according to claim 1, wherein on the touch surface (15, 15') of the container (13, 13', 13''') markings (22) that are characterized and/or can be felt by touch are provided.

* * * * *

UNITED STATES PATENT AND TRADEMARK OFFICE

CERTIFICATE OF CORRECTION

PATENT NO. : 8,601,903 B1
APPLICATION NO. : 10/088451
DATED : December 10, 2013
INVENTOR(S) : Klein et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 85 days.

Signed and Sealed this
Twenty-second Day of September, 2015

Michelle K. Lee

Michelle K. Lee
*Director of the United States Patent and Trademark Office*